US005110111A

United States Patent [19]

Gompertz et al.

[11] Patent Number: 5,110,111

[45] Date of Patent: May 5, 1992

[54] APPARATUS INCLUDING A U-SHAPED BIN HAVING A BAR GRID NETWORK FOR UNIFORMLY STACKING CUT SHEETS OF PRINTED MEDIA

[75] Inventors: Ronald S. Gompertz; Victor Escobedo, both of San Diego, Calif.

[73] Assignee: Hewlett-Packard Company, Palo Alto, Calif.

[21] Appl. No.: 486,332

[22] Filed: Feb. 28, 1990

[51] Int. Cl.[5] ..... B65H 29/00

[52] U.S. Cl. ..... 271/186; 271/209; 271/213

[58] Field of Search ..... 271/67, 73, 175, 182, 271/184–187, 207, 209, 213

[56] References Cited

U.S. PATENT DOCUMENTS

| | | | |
|---|---|---|---|
| 2,754,119 | 7/1956 | Morgan et al. | 271/175 |
| 3,704,884 | 12/1972 | Nicolay et al. | 271/175 |
| 4,220,323 | 9/1980 | Smith | 271/207 |
| 4,300,757 | 11/1981 | Koiso et al. | 271/207 |
| 4,575,069 | 3/1986 | Burkhart | 271/207 |
| 4,804,174 | 2/1989 | ter Horst | 271/175 |
| 4,828,248 | 5/1989 | Jackson et al. | 271/186 |
| 4,961,091 | 10/1990 | Kasuya et al. | 271/207 |
| 4,993,701 | 2/1991 | Tosserams | 271/207 |
| 4,995,602 | 2/1991 | Nakadai et al. | 271/207 |

FOREIGN PATENT DOCUMENTS

| | | | |
|---|---|---|---|
| 644725 | 11/1927 | France | 271/86 |
| 56456 | 5/1981 | Japan | 271/186 |
| 198252 | 11/1984 | Japan | 271/209 |
| 19639 | 1/1985 | Japan | 271/207 |
| 31465 | 2/1985 | Japan | 271/209 |

*Primary Examiner*—Robert P. Olszewski
*Assistant Examiner*—Boris Milef

[57] ABSTRACT

A method and apparatus for stacking cut sheets of printed media wherein the leading edge of sheets received from a printer or plotter are first passed vertically downward into a bin and then rotated through an angle away from the printer or plotter. The front side member of the bin has a convex, upwardly facing and smoothly contoured section thereof over which cut sheets are laid with a uniform weight distribution and then down into an adjacent sheet output collection tray. This method of sheet transport and stacking has the advantage of minimizing the crumpling and curling of the cut sheets during the sheet handling and accumulation process. In addition, this method rapidly and efficiently moves the cut sheets out of the way of upstream sheet feeding to thereby prevents paper jam and crushing of paper in the plotter or printer. The apparatus for carrying out this method is of economical and durable construction and may be readily retrofitted to existing large size plotters for handling and stacking relatively large size cut sheets of printed media.

9 Claims, 4 Drawing Sheets

APPARATUS INCLUDING A U-SHAPED BIN HAVING A BAR GRID NETWORK FOR UNIFORMLY STACKING CUT SHEETS OF PRINTED MEDIA

TECHNICAL FIELD

This invention relates generally to the accumulation of cut sheets of printed media received from a printer or plotter. More particularly, this invention is directed to an improved method and apparatus for transporting and stacking the cut sheets of printed media in such a manner as to minimize crumpling and curling of the stacked sheets.

BACKGROUND ART

Printers and plotters used for generating text and graphics on cut sheets of printed media have previously been equipped with literally hundreds of different types of media accumulating apparatus. These apparatus are either an integral part of the printer or plotter or they are removably attached thereto and are normally readily accessible to an operator for retrieving the media having text or graphics printed thereon. In the field of plotters and particularly large format plotters which produce correspondingly large size sheets of printed media, a problem of sheet crumpling and curling is presented by the manner in which these sheets are transported and stacked after printing or plotting thereon.

In the past, many differently configured devices have been used for the collection of these cut sheets and have been variously referred to in these arts as "catch trays", "catch bins", "paper collection trays" and the like. However, none of these known passive prior art media collection devices have been operative to prevent a certain undesirable crumpling and curling of the cut sheets and stack and arrange the cut sheets in an orderly fashion. This fact has in part been a result of the specific configurations of these sheet collection devices and their corresponding media handling and operational characteristics. More particularly, this introduction of crumple and curl into the accumulated cut sheets has been a result of the inability of these paper and media handling devices to uniformly distribute the weight of the accumulated media during both media transport and stacking. This introduction of crumple and curl into the cut sheets has also been a result of the inability of these prior art paper stacking apparatus to adequately move cut sheets out of the way of the upstream moving paper, sometimes causing the paper to jam up in the plotter and be crushed. Additionally, when conventional paper trays are used to accumulate cut sheets being fed into the tray one after another and sliding on top of the previous sheet, the sheets may hit earlier received sheets unevenly at the edges when the latter become skewed in the tray. This can also aggravate the problem of sheet curling and buckling.

Other active types of paper collection devices such as reciprocating tables have been known to work quite well in certain applications and environments. However, these "active" devices require motors, control logic and related electronic circuitry and involve significantly higher costs relative to passive paper stacking devices of the type disclosed and claimed herein.

DISCLOSURE OF INVENTION

Accordingly, it is an object of the present invention to provide an improved passive method and apparatus for the handling, transport and accumulation of printed media which minimizes the above crumpling and curling problem during media stacking. This invention thus represents a significant improvement in this regard relative to the paper handling and stacking properties and capabilities of any presently known passive prior art devices such as "catch trays", "catch bins", or the like.

This object is achieved by, among other things, our discovery of a unique and novel method for transporting and then stacking sheets of printed media exiting an output sheet feeder of a printing mechanism. Each sheet is defined by at least a leading edge and a trailing edge, and each of the sheets is initially passed vertically downward a predetermined distance with respect to the output of the sheet feeder. Then the trailing edge of each sheet exiting the sheet feeder is rotated about an axis of rotation defined by the leading edge of the sheet and in a direction away from the sheet feeding mechanism. Next, a first section of each sheet is brought to a rest position at one location, and movement of a second section of each sheet is continued in a direction away from the sheet feeding mechanism and then into or toward a predefined plane of cut sheet accumulation.

In the above process, the second section of each of the stacked sheets forms a loop passing and extending from the first section of each sheet and into or toward the predefined plane of paper accumulation. This paper handling process improves the uniformity of the weight distribution within the stacked sheets and thereby minimizes the crumpling, curling, and slipping of the accumulated sheets of printed media. In addition, the radius of the above loop in the cut sheets serves to bend and guide the sheets in a manner which tends to avoid creasing the sheets during the sheet accumulating process.

Another object of this invention is to provide a new and improved paper stacking apparatus of the typed described which is completely "passive" and which requires no moving parts such as motors.

Another object is to provide a new and improved paper stacking apparatus of the type described which operates to rapidly and efficiently move the cut sheets being stacked out of the way of upstream paper movement, thereby eliminating problems associated with jamming up the plotter from which the sheets are fed.

Another object of this invention is to eliminate sliding friction contact between successively stacked sheets being accumulated at the output of a plotter or printer.

Another object of this invention is to provide a new and improved media stacking apparatus for carrying out the above method and one which is of economical and durable construction.

Another object is to provide a new and improved media stacking apparatus of the type described which may be readily and easily adjusted for the handling of different types and sizes of printed media and which may also be used with many types of existing large scale plotters.

A feature of this invention is the provision of media stacking apparatus of the type described which includes a sheet receiving bin having a back support member, a floor or bottom support member which is generally perpendicular to the back support member, and a front support member. The front support member is spaced from the back support member, and this space defines a gap portion for receiving the leading edge of cut sheets fed from a sheet feeder mechanism. The front support member includes a first section thereof which intersects the bottom support member at a preselected angle slants away from the back support member. The front support member further includes a second section which is integral with the first section and extends upwardly from the first section and also slants away from the back support member. The second section has an upwardly facing convex curvature for receiving sheets which are moving away from the sheet feeding mechanism, and the sheets fed toward the bottom support member of the sheet receiving bin will subsequently be received by the first and second sections of the front support member.

Sheet motion out of the sheet feeding mechanism is continuous so that each sheet is caused to extend over the second section of the front support member and then toward or into an adjacent plane of single sheet media accumulation. In a preferred embodiment of this invention, the second section of the front support member comprises a plurality of hook-shaped rib members which bend in a curvature away from the sheet feed mechanism.

Another feature of this invention is the provision of media stacking apparatus of the type described wherein the front support member, the back support member, and the bottom support member are all constructed of a grid framework of horizontal and vertical intersecting bars or wires. These bars or wires are arranged in such a way as to facilitate media motion and inhibit curl at the edges of the cut sheets.

Another feature of this invention is the provision of media stacking apparatus of the type described wherein the front support member intersects with the floor or bottom support member at a preselected angle with respect to a horizontal surface of the floor support member. This angle may be varied to change the degree of slant of the front support member depending upon the size and weight of cut sheets being accumulated.

Another feature of this invention is the provision of media stacking apparatus of the type described which further includes a tray member which extends horizontally above the bottom support member and between the front and back support members for receiving cut sheets passing vertically downward from the sheet feeding mechanism. When each cut sheet reaches the tray member which is spaced a given distance above the bottom member, it rotates about its leading edge axis of rotation and ultimately loops over the plurality of hook-shaped rib members. Each cut sheet then comes to rest into an output tray which advantageously may be a bar grid extension of the floor or bottom support member.

Another feature of this invention is the provision of a media stacking apparatus of the type described which is lightweight and collapsible thus assuring easy shipping, handling, and storage.

These and other objects, advantages, and features of this invention will become more readily apparent in the following description of the accompanying drawings.

DESCRIPTION OF THE PREFERRED EMBODIMENT

Figure 1A:
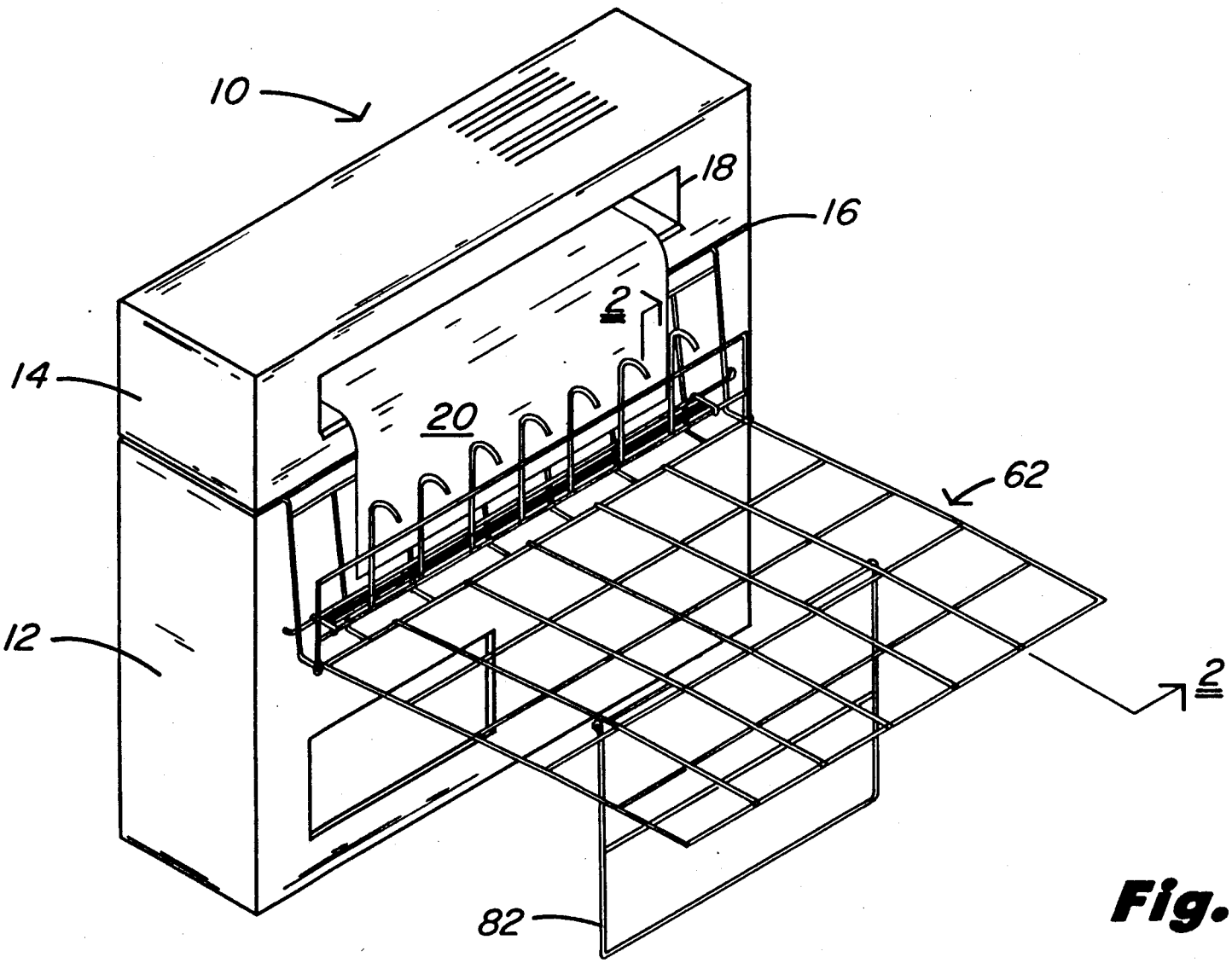
FIG. 1A and is an isometric view of cut sheets being fed from a large format or E-size plotter into the novel sheet receiving and stacking apparatus according to this invention.
Figure 1B:
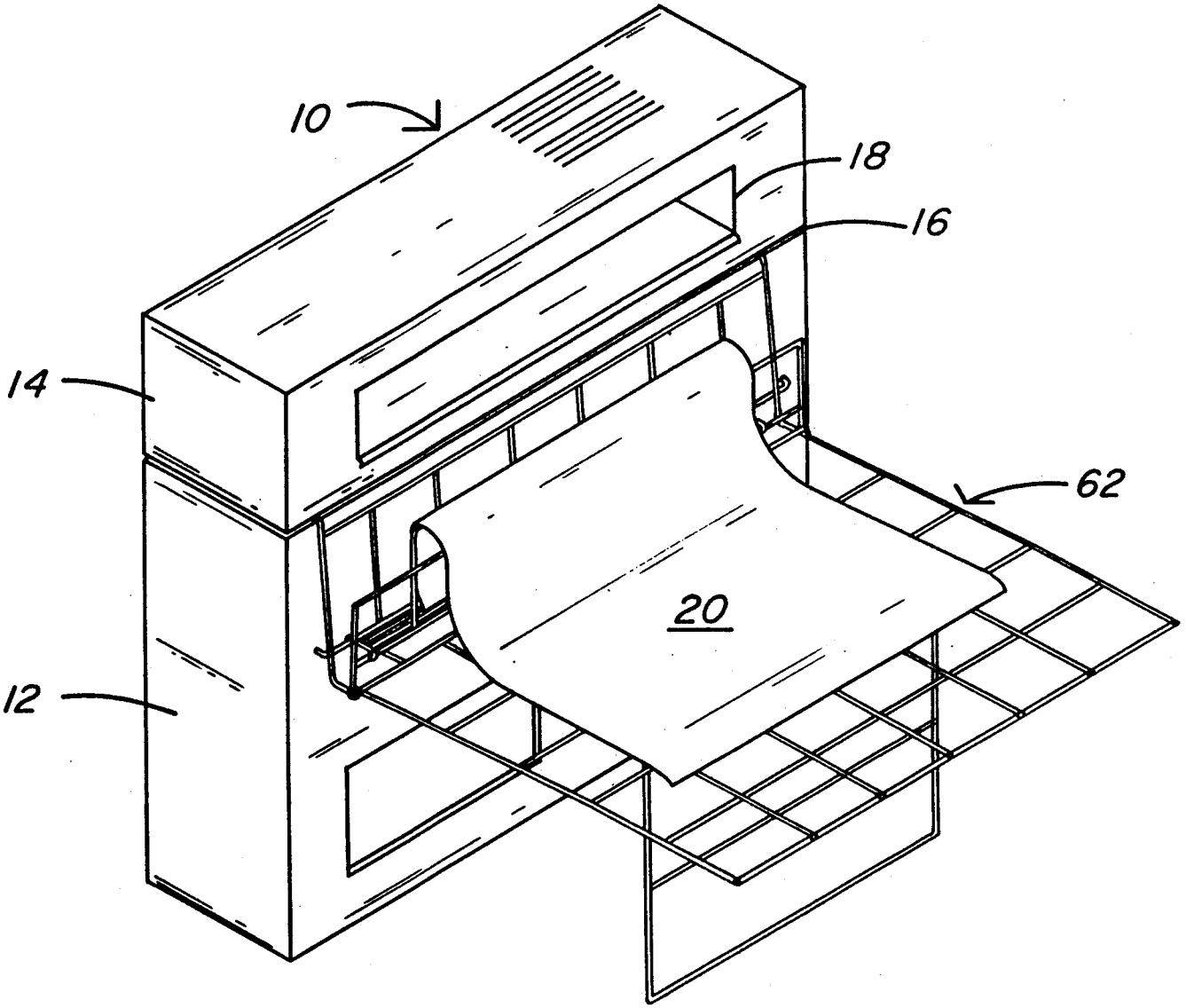
FIG. 1B is an isometric view of the cut sheets after they have moved into the generally U-shaped input bin of the sheet receiving apparatus where they are rotated away from the sheet feeding mechanism of the plotter.

Referring now to FIGS. 1A and 1B, there is shown a large scale plotter which is designated generally as 10 and includes a lower housing 12 and a removable upper housing 14 which is separated from the lower housing by a space 16. The space 16 is used to receive the sheet receiving and stacking apparatus according to the present invention. This sheet stacking apparatus is constructed as shown using a wire or bar grid configuration with wires and grids arranged in the planes shown and running generally perpendicular to one another to define the various members of the paper stacking apparatus described and claimed herein. The lower housing 12 is designed to support and shield a large size plotter (not shown) mounted therein. The upper housing 14 is designed to support and shield a sheet feeding mechanism, also not shown. The upper housing 14 includes a sheet feed window of port 18 from which cut sheets 20 are fed into the wire grid sheet stacking apparatus described further below. Typically, this wire grid will be constructed of 3/16 inch steel wire which has been plated with nickel-chrome.

The sheet stacking apparatus includes a back member consisting of a plurality of upstanding bars or wires 22 which are integrally joined at the top ends thereof with a continuous horizontal bar 24 and are further integrally joined at their lower ends with a floor or bottom member. This bottom member also consists of a plurality of horizontal floor bars or wires 26. The floor or bottom bars or wires 26 are integrally joined to a continuous horizontal front floor bar 28 whose ends extends slightly past the edges of the end floor bars. These ends of the front floor bar 28 receives upstanding end bars 30 and 32 of a front support member of the apparatus.

The front support member of the apparatus further comprises a horizontal bar 34 which is integrally joined with the upstanding end bars 30 and 32, and the frame consisting of the bar members 30, 32, and 34 is also referred to herein and claimed as a first section of the front support member of the sheet receiving bin. A plurality of vertical hook-shaped ribs 36 abut the inside surface of the horizontal bar 34, and these ribs 36 form a second section of the front support member. The lower ends of the hook-shaped ribs 36 are integrally joined to a horizontal front bar 38 of an intermediate sheet receiving tray 40. The sheet receiving tray 40 is positioned as shown between the front and back members of the U-shaped sheet receiving bin and is spaced vertically above the floor or bottom member 26 of the sheet receiving apparatus.

Figure 2:
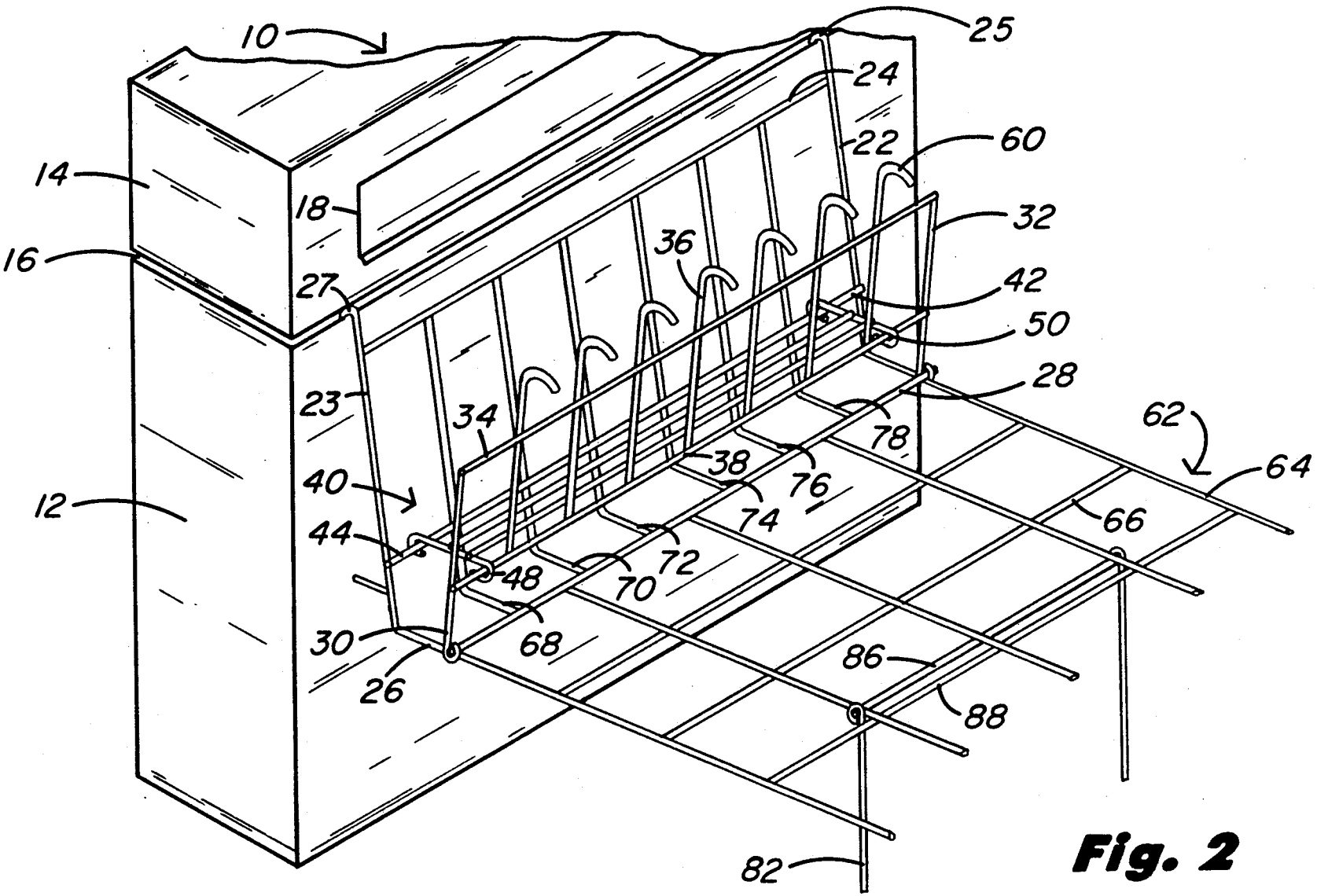
FIG. 2 is an enlarged isometric view of U-shaped sheet receiving area of the sheet stacking apparatus of a preferred embodiment of the invention.

The back support member further comprises a rear horizontal bar 42 which is joined to the outside upstanding ribs 22 and 23 of the back support member, and these ribs 22 and 23 have curved ends 25 and 27 extending as shown into openings of a front wall of the lower housing member 12. A pair of end fasteners 48 and 50 having hook-shaped downwardly facing ends which correct the tray member 40 to the horizontal bars 38 and 42. The tray member 40 includes a pair of spaced centrally located horizontal bars 52 and 54 which extend as shown from one end of the tray member 40 to the other as seen in more detail in the enlarged isometric view in FIG. 2. As further described below, the cut sheets 20 are fed into a downward direction as shown and into the sheet receiving tray 40 in the direction of the two horizontal bars 52 and 54. From this location each cut sheet will rotate in a direction of the arrow 56 to first form a loop 57 before coming to rest in the position shown on the tops 60 of the upstanding vertical rib members 36. From this position, the sheets extend onto the upper surface of the output tray 62 described below, and there is no sliding friction contact between adjacent sheets as is the case with the use of prior art paper trays.

Figure 3:
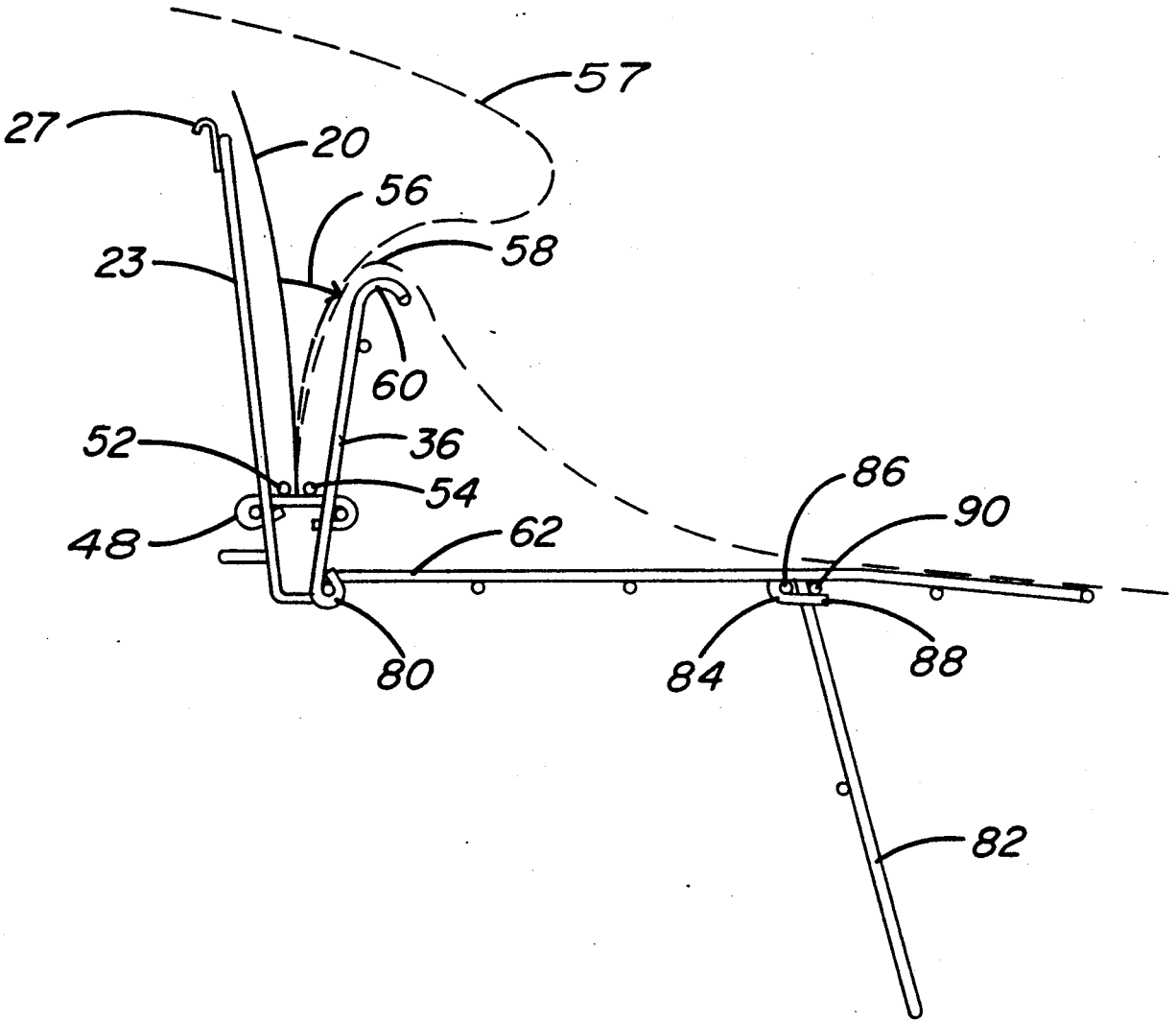
FIG. 3 is a cross-sectional view taken along lines 2—2 of FIG. 1A.

A sufficient loop 57 is required to assure that the media falls in the direction of the arrow and onto the output tray 62 as indicated in FIG. 3. The size of the loop 57 may be controlled by varying the distance between the plotter exit window 18 and the sheet receiving tray 40. This distance in turn determines the force/-weight balance on the sheets being stacked and should be large enough to provide a loop 57 which is sufficiently large to produce enough downward momentum of the sheets to assure good "loop/flip" stacking action on the output tray 62 as indicated above.

As shown in FIG. 1A, the cut sheets 20 proceed further over the tops 60 of the rib members 36 and onto the top surface of an output tray which is designated generally as 62. This rotational movement of the cut sheets 20 in the direction of the arrow 56 and over the vertical upstanding rib members 36 of the front support and then down into the output tray 62 provides an overall stacking weight distribution within the stacked sheets 20 which tends to prevent paper curling and crumpling. This desirable stacking weight distribution is in significant contrast to typical prior art paper bin stacking approaches where all of the cut sheets are stacked one on top of another in a relatively small rectangular area where the sheets may sometime be difficult to retrieve.

The range of sheet sizes that can be stacked using the above described method and apparatus is facilitated by the weight distribution between the convex ribs 36 of the front section of the bin and the output sheet receiving tray 62. Smaller sheets will hang freely over the tops 60 of the convex upstanding ribs 36 and there be held in static equilibrium. Larger sheets will be draped over both the rib members 36 and the adjacent output tray 62 to reach a static equilibrium. Thus, there are two force/weight equilibrium conditions that may be present in the above operation. But it is important to note that in either case, there is no condition where sheets are fed into direct sliding contact with each other and with a significant dynamic friction therebetween. In addition, there is no impacting of the adjacent surfaces and edges of previously deposited sheets in the manner indicated above when prior art trays are used to accumulate sheets received one on top of another.

The output tray 62 consists of a plurality of integrally joined and perpendicularly arranged horizontal bars 64 and 66. These parallel horizontal bars 66 are connected to the lower bar member 28 of the sheet receiving apparatus at the points 68, 70, 72, 74, 76, and 78. The horizontal bar member 28 is free to rotate as indicated in FIG. 3 within the lower hook sections 80 of the vertical end bars 30 of the front support member. A leg support member 82 has a hook section 84 on its upper end which loops around one of the horizontal bars 86 of the output paper collection tray 62. The tail 88 of the hook 84 comes to rest against an adjacent bar 88 of the output tray 62. The rotatable output tray 62 and its stand support member 82 thus render the entire apparatus collapsible when not in use.

EXAMPLE

The following parameters are given by way of example only and are in no way limiting on the scope of the appended claims. These parameters are merely intended to describe a typical handling and stacking operation and illustration of how the novel sheet stacking apparatus according to the present invention is uniquely adapted and operable to rapidly and efficiently stack the continuously moving cut sheets out of the way of interference with the upstream motion of paper flow. In addition, this operation provides for the simultaneous and uniform stacking of cut sheets with a minimum of crumpling, curling, and paper slippage. Furthermore, the present apparatus is totally passive in operation and requires no motors or other moving parts.

Using the above apparatus, fifty (50) to one hundred (100) cut sheets of a standard size "C", "D", or "E" (Standard American and European paper size) are fed into the sheet receiving bin at a typical rate of one inch per second. Size "C" is 17×22 inches; Size "D" is 22×34 inches, and Size "E" is 34×44 inches according to this standard. However, Vellum and translucent medias may also be stacked. These sheets will have a momentum so that when the leading edge of the cut sheets reach the sheet receiving tray 40, the individual sheets will rotate in the direction of the arrows 56 shown in FIG. 3 and will traverse the dotted line path 58. These sheets will then come to rest in the position shown in FIG. 1B.

The paper stacker described above was developed primarily for use with an electrostatic plotter designed for handling paper, Vellum, and translucent media. However, other types of plotters and other types of media are contemplated within the scope of the appended claims.

Various modifications may be made in and to the above described embodiment without departing from the scope of this invention. For example, the size, shape, and geometrical configuration of the U-shaped sheet receiving input bin and its associated flat output tray extending therefrom may be modified in accordance with paper size, weight, and transport speed requirements. In addition, the above-described media stacking apparatus may be used without the output tray 62 in situations where the upstanding ribs 36 are sufficient to support smaller size sheets. Also, for the latter use, an alternative embodiment of this invention would be to suspend the sheet receiving bin at a predetermined angle with respect to vertical and then feed the cut sheets first down into the bin at this angle and then over the convex tops of the ribs 60 as previously described where the sheets will come to rest. This alternative arrangement would thus allow the bin to be suspended on the side of a pedestal and positioned beneath the plotter in a more out-of-the-way location if desired. Also, in this latter arrangement an adjustable tray equivalent to the tray 40 described above may be adjustably positioned at a chosen location between the top and bottom of the bin as determined by the size of the sheets being stacked.

Accordingly, this alternative embodiment as well as other design variations of the above described preferred embodiment are clearly within the scope of our appended claims.

We claim:

1. Sheet receiving and stacking apparatus for accumulating cut sheets fed from the output of a sheet feeding apparatus which comprises:

a. a generally U-shaped sheet receiving bin connected to receive sheets fed from an adjacent sheet feeding mechanism, b. an output tray connected to said bin for accumulating and stacking sheets passing over one surface of said bin and moving away from said sheet feeding mechanism, and c. said bin having a first upstanding member positioned adjacent to said sheet feeding mechanism and a second upstanding member positioned away from said first upstanding member and a floor member extending between said first and second upstanding members and adjacent to said output tray, said second upstanding member being defined in part by a bar grid network including a plurality of hook-shaped rib members which partially define the generally U-shaped contour of said bin, said rib members having aligned convex upwardly facing surfaces operative to come into direct contact with a stack of cut sheets moving away from said bin.

2. The apparatus defined in claim 1 wherein said output tray is an extension of said floor member of said bin and may be fabricated of grid lines which extend from said floor member of said bin.

3. Media stacking apparatus for operation with a sheet feeding mechanism, comprising: a sheet receiving bin having a back support member positioned adjacent to said sheet feeding mechanism, a bottom support member generally perpendicular to said back support member, and front support member spaced from said back support member by the width dimension of the bottom support member, said front support member having a first section thereof which intersects with said bottom support member at a predetermined angle and slanting away from said back support member and a second section thereof also extending at an angle away from said back support member, said second section having an upwardly facing convex curvature for receiving sheets thereover, whereby sheets fed toward said bin are rotated away from said back support member and received by said first and second sections of said front support member, and said sheets extend over said second section of said front support member, and a tray member which extends horizontally above said bottom support member and between said front and back support members for receiving cut sheets passing into said sheet receiving bin.

4. The apparatus defined in claim 3 wherein said front support member, said back support member, and said bottom support member are all constructed of a grid framework of horizontal and vertical intersecting bars or wires.

5. The apparatus defined in claim 3 which includes a sheet receiving output tray which is connected to said front support member for receiving cut sheets therefrom.

6. Sheet receiving and stacking apparatus for accumulating cut sheets fed from the output of a printer or plotter which comprises:

a. a generally U-shaped sheet receiving bin connected to receive sheets fed from an adjacent sheet feeding mechanism, and b. a front section forming a part of said U-shaped sheet receiving bin and including an upstanding member having a convex upper surface over which said sheets may fall one on top of another as the accumulate, and c. said upstanding member includes a plurality of aligned upstanding hook-shaped ribs having convex aligned top portions for receiving said sheet and suspending said sheets along a contoured path as they accumulate one on top of another, whereby sliding friction contact between successively deposited sheets is minimized, and the support for the weight of cut sheets is distributed over said convex upper surface, tending to stabilize the stacking of cut sheets and preventing slippage therebetween.

7. A combination sheet receiving bin and sheet stacking apparatus comprising:

a. a back wall structure, b. a front wall structure, c. a bottom wall structure interconnecting said back and front wall structures, and d. said front wall structure including a plurality of hook-shaped members which form part of a bar grid network and have aligned convex surfaces spaced along a length dimension of said front wall structure and being operative to receive a stack of cut sheets of paper which are introduced into said bin from an adjacent printer and therein move toward said front wall structure and then over said aligned convex surfaces where they are uniformly stacked for easy access and accumulation.

8. The combination defined in claim 7 wherein all of said front, back and bottom wall structures are formed bar or wire grid members.

9. The combination defined in claim 8 which further includes a tray member overlying said bottom wall structure for receiving cut sheets of paper.

* * * * *